US007540803B2

(12) United States Patent
Sells

(10) Patent No.: US 7,540,803 B2
(45) Date of Patent: Jun. 2, 2009

(54) VENTILATING CAP FOR THE RIDGE OF A ROOF

(76) Inventor: Gary L Sells, P.O. Box 428, Mishawaka, IN (US) 46546-0428

( * ) Notice: Subject to any disclaimer, the term of this patent is extended or adjusted under 35 U.S.C. 154(b) by 94 days.

(21) Appl. No.: 11/162,868

(22) Filed: Sep. 27, 2005

(65) Prior Publication Data

US 2007/0072539 A1 Mar. 29, 2007

(51) Int. Cl.
*F24F 7/02* (2006.01)

(52) U.S. Cl. ..... 454/365

(58) Field of Classification Search ..... 454/365; 52/43

See application file for complete search history.

(56) References Cited

U.S. PATENT DOCUMENTS

| | | | | | |
|---|---|---|---|---|---|
| 3,949,657 | A | | 4/1976 | Sells | |
| 5,022,203 | A | * | 6/1991 | Boyd | 52/199 |
| 5,092,225 | A | | 3/1992 | Sells | |
| 5,603,657 | A | * | 2/1997 | Sells | 454/359 |
| 5,830,059 | A | | 11/1998 | Sells | |
| 6,039,646 | A | * | 3/2000 | Sells | 454/365 |

* cited by examiner

*Primary Examiner*—Steve McAllister
*Assistant Examiner*—Helena Kosanovic
(74) *Attorney, Agent, or Firm*—Baker & Daniels LLP

(57) ABSTRACT

A ventilating device for a roof having at least one vent opening. The ventilating device includes a cover extending along the vent opening. The cover may include two plies of material, a top ply and a bottom ply that are spaced apart by connecting members extending between the plies. The ventilating device may also include coiled members extending longitudinally along the cover on opposite sides of the vent opening to support the cover over the vent opening. The coiled members may have spaced coils defining passages therebetween to permit venting of the structure through the vent opening and the passages defined by the coils. A portion of the bottom ply of material of the cover is removed, where the coiled members are attached to the cover. The ventilating device may further include at least one air-permeable filter member to inhibit moisture and debris from entering in the vent opening through the passages. Two adjacent longitudinal portions of the bottom ply of material may be removed for the attachment of each coil member. The spaced coils of the coil members may be threaded interstitially between the connecting members extending between the plies of the cover and held by the portion of the bottom ply remaining between the adjacent longitudinally removed portions of the bottom ply.

42 Claims, 15 Drawing Sheets

VENTILATING CAP FOR THE RIDGE OF A ROOF

BACKGROUND

This invention relates to roof ridge vents for ventilating an attic or upper story of building structures, and in particular, to roof ridge vents that in one embodiment utilizes spiral or circular vent parts.

It is desirable that the attic or upper story of a building structure be vented to atmosphere to prevent heat buildup within the structure. Roof ridge vents have become increasingly popular in providing this needed ventilation. Roof ridge vents extend along the ridge of a pitched roof, and cover a ventilating opening that is cut longitudinally in the roof, usually extending parallel to, and on both sides of, the roof ridge board. A ventilating cap is installed on the roof and extends over the ventilating opening. The ventilating cap includes vent parts attached to the roof adjacent and on both sides of the ventilating opening, which have ventilating passages extending therethrough to vent the building. Examples of such vent caps are disclosed in U.S. Pat. No. 3,949,657 and 5,092,225.

Another ventilating cap for ridge roof is disclosed in U.S. Pat. No. 5,830,059 that relates to a roof ridge vent in which a ventilating cap consists of a cover extending over the vent opening and which is supported on a roof by longitudinally extending coil springs. The springs are stretched so that the distance between the coils of the springs provides the desired passages through which venting takes place. Porous material, such as a block of foam rubber, may be provided to extend longitudinally adjacent the coiled springs to restrict entry of wind-driven moisture into the ventilating opening. According to another embodiment in the '059 Patent, nonwoven batting material may either be installed within the coils of the spring or may be retained by the springs and extend over the ventilation opening, which can also inhibit entry of wind-driven moisture into the ventilation opening. The '059 Patent also discloses a movable baffle that normally rests in an inactive position against the surface of the roof and responds to wind in excess of a predetermined velocity to move upwardly covering one side of the spring, thereby preventing wind-driven moisture from entering the building. Before wind reaches the predetermined velocity, the baffle remains in an inactive position allowing free venting from the structure.

It is an object of the present invention to provide additional embodiments and improvements of the aforementioned ventilating caps.

SUMMARY OF THE INVENTION

In one embodiment of the invention, a ventilating device for a roof having a longitudinally extending ridge board and at least one vent opening adjacent the ridge board is provided, and the ventilating device includes a cover extending over the ridge board and longitudinally along the vent opening. The cover may include two plies of material, a top ply and a bottom ply that are spaced apart by connecting members extending between the plies. The ventilating device also includes coiled members extending longitudinally along the cover on opposite sides of the vent opening to support the cover over the vent opening. The coiled members have spaced coils defining passages therebetween to permit venting of the structure through the vent opening and the passages defined by the coils. A portion of the bottom ply of material of the cover is removed, where the coiled members are attached to the cover.

The ventilating device may further include at least one air-permeable filter member to inhibit moisture and debris from entering in the vent opening through the passages. The air-permeable filter member may be installed within the coils of at least one of the coil members. The air-permeable filter member may be a thin sheet of air-permeable, moisture-resistant fabric material that is rolled within at least one of the coiled members.

The filter member may also be an air-permeable, moisture-resistant thin sheet of fabric that is wrapped at least partially around the outside of at least one of the coiled members.

The filter member may also be an air-permeable, moisture-resistant thin sheet of fabric that is folded over and positioned between two coiled members.

The filter member may also include a foam or batting material positioned between two coiled members. The foam or batting material may include spaced slits for receiving at least a portion of the spaced coils.

The portion of the bottom ply of material that is removed may be parallel to the longitudinal direction of the ventilating device. The coil members may be attached to the cover, where the bottom ply has been removed using an adhesive or an adhesive member.

Two adjacent longitudinal portions of the bottom ply of material may be removed for the attachment of each coil member. The spaced coils of the coil members may be threaded interstitially between the connecting members extending between the plies of the cover and held by the portion of the bottom ply remaining between the adjacent longitudinally removed portions of the bottom ply. The longitudinally removed portions of the bottom ply may be parallel to one another.

In another embodiment of the invention, a ventilating device for a roof having a longitudinally extending ridge board and at least one vent opening adjacent the ridge board is provided, and the ventilating device includes: a cover extending over the ridge board and longitudinally along the vent opening, wherein the cover includes two plies of material, a top ply and a bottom ply, spaced apart by connecting members extending between the plies. The ventilating device also includes coiled members extending longitudinally along the cover on opposite sides of the vent opening to support the cover over the vent opening. The coiled members may have spaced coils defining passages therebetween to permit venting of the structure through the vent opening and the passages defined by the coils. The coiled members may be threaded onto the cover with the spaced coils located interstitially between the connecting members extending between the plies.

The ventilating device may have two longitudinally extending portions of the bottom ply of material removed in an area where the coil members are threaded onto the cover. The ventilating device may also include two longitudinally extending slots, where the bottom ply portions are removed, and the slots may be parallel to one another.

The ventilating device may also include an additional longitudinally extending coil member attached to the cover along the central portion thereof. The coil member extending along the central portion of the cover may be attached thereto in the same manner as the venting coil members.

The cover may be split in at least one location in a direction that is substantially perpendicular to the longitudinal direction coinciding with the ridge board. The cover may include sections on opposite sides of the split, and the sections may be held together by the coiled members. The ventilating device may be foldable along the splits.

In still another embodiment of the invention, a ventilating device for a roof having a longitudinally extending ridge board and at least one vent opening adjacent the ridge board is provided, and the ventilating device includes a cover extending over the ridge board and longitudinally along the vent opening, wherein the cover includes two plies of material, a top ply and a bottom ply, spaced apart by connecting members extending between the plies. The covering may be split into at least two sections. The ventilating device may also include coiled members extending longitudinally along the cover on opposite sides of the vent opening to support the cover over the vent opening. The coiled members may have spaced coils defining passages therebetween to permit venting of the structure through the vent opening and the passages defined by the coils. The coils may join the split sections of the cover member to one another.

The splits between the sections may be substantially perpendicular to the longitudinal direction coinciding with the ridge board.

The cover of the ventilating device may be foldable along the splits between the sections. The ventilating device may include at least three sections, and the ventilating device may be folded so that a top ply of one section is adjacent a top ply of another section, and the bottom ply of the another section is adjacent the bottom ply of the third section.

The coiled members may be threaded onto the cover with the spaced coils located interstitially between the connecting members extending between the plies. Two longitudinally extending portions of the bottom ply of material may be removed in an area where the coil members are threaded onto the cover. The ventilating device may include two longitudinally extending slots where the bottom ply portions are removed. The slots may be parallel to one another.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
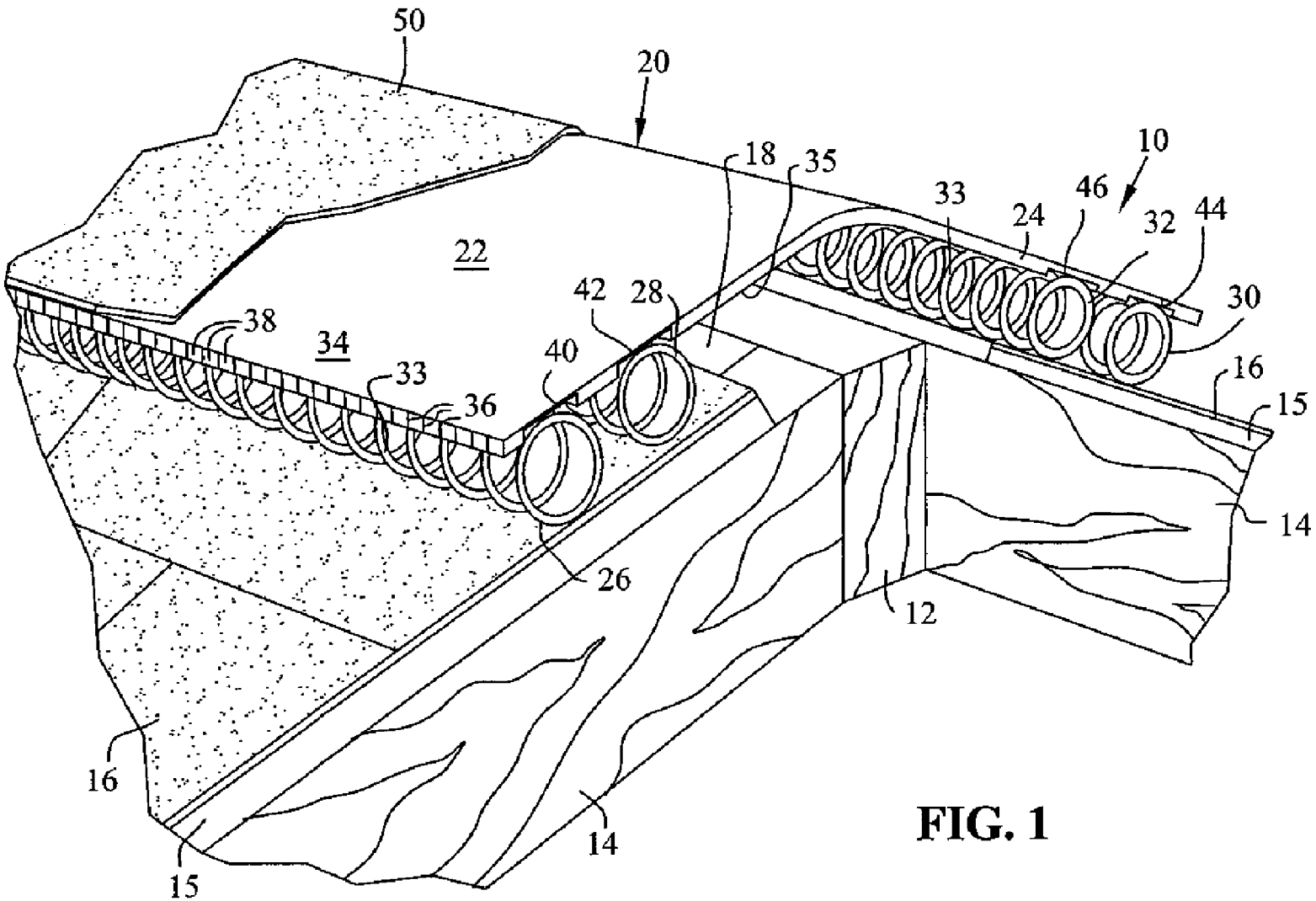
FIG. 1 is a fragmentary view in perspective of one embodiment of a roof ridge vent made pursuant to the teachings of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
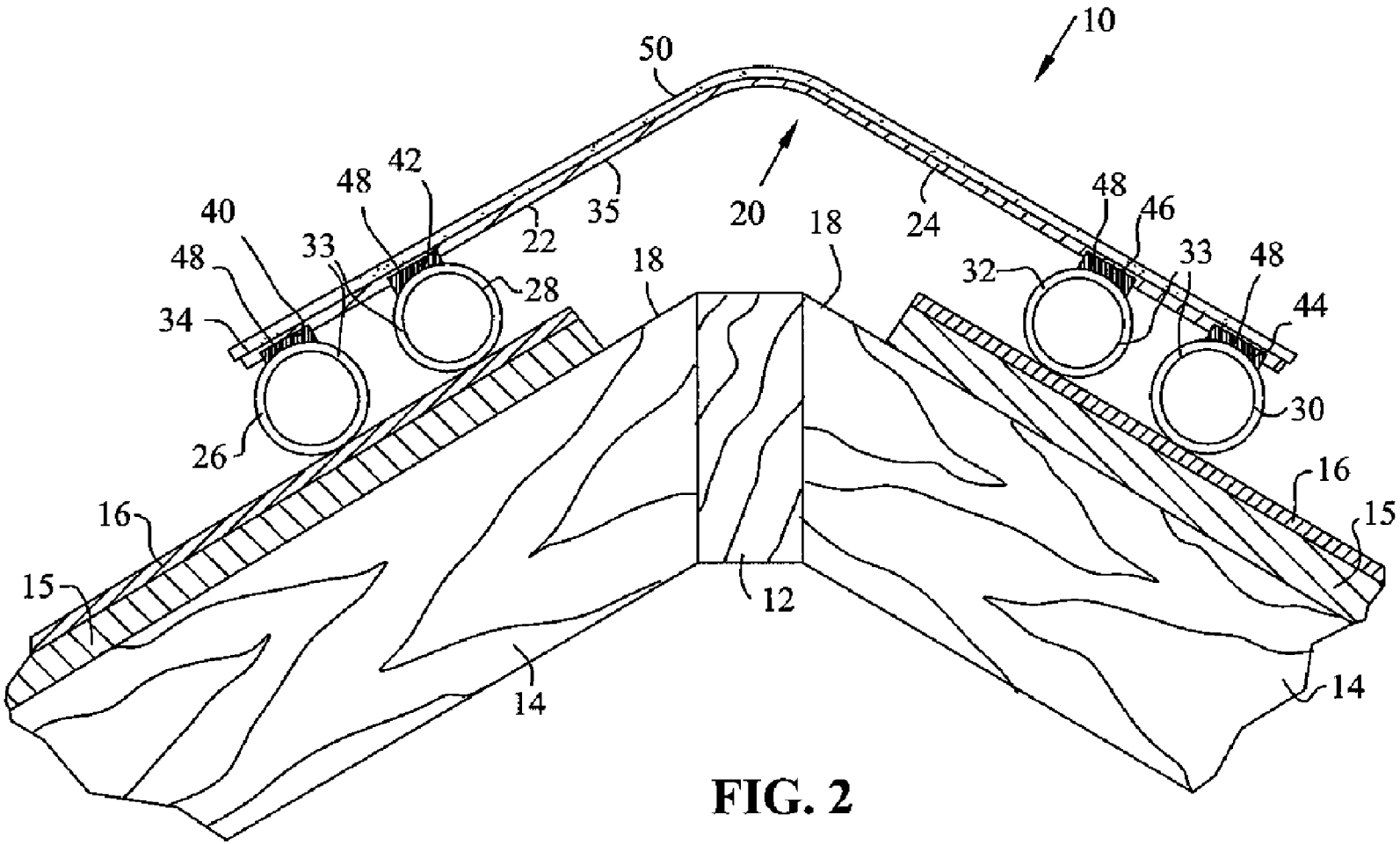
FIG. 2 is an end view of the ridge vent of FIG. 1.

Referring now to FIGS. 1 and 2, a first embodiment of a roof vent of the present invention is generally referred to as 10. Vent 10 is applied to a conventional pitched roof, which includes a ridge board 12, which extends longitudinally along the ridge of the roof and which is supported by transversely spaced inclined rafters 14, as is well known to those skilled in the art. A conventional underlayment 15 is mounted to rafters 14, using a known method, such as nails (not shown), and conventional shingles 16 are mounted to the underlayment 15, as is known to those skilled in the industry of roof construction.

According to the invention, longitudinally extending vent openings 18 are provided between underlayment 15 and ridge board 12 and extend parallel to the ridge board. Accordingly, air trapped in the attic or upper story of the structure may be vented through vent openings 18. A cap or cover is provided and generally indicated by 20 and bridges across the vent openings 18 and ridge board 12. Cover 20 includes two side portions 22, 24, which are supported off the roof by a first pair of spiral spring supports or coiled members 26, 28, and a second pair of spiral-wound springs 30, 32, respectively. In the embodiment shown, each of the springs 26-32 consists of coils 33 or spirals that form passages through which air may pass. Springs 26-32 extend substantially parallel to one another and also parallel to vent openings 18 and ridge board 12.

In the embodiment shown, cover 20 is a multilayered or plied structure and includes a top ply 34, a bottom ply 35, and a plurality of connecting members 36 interconnecting top ply 34 and bottom ply 35. A plurality of passages 38 are defined by top ply 20, bottom ply 35, and connecting members 36 and extend therebetween. Passages 38 are oriented in a direction that is approximately perpendicular to vent openings 18 and ridge board 12. Coinciding with the attachment of springs 26-32, respectively, are slots 40, 42, 44, and 46. Slots 40-46 are formed by the removal of portions of bottom ply 35 and may also extend into connecting members 36. The slots do not extend into top ply 34 though. Slots 40-46 extend in a longitudinal manner and are generally parallel to one another and vent openings 18 and ridge board 12. Springs 26-32 are mounted to cover 20 in an area coinciding with respective slots 40-46 using an adhesive or adhesive member 48 or other well-known means of attachment.

Cover 20 may be made from a polymer material, such as vinyl, polyethylene, or polypropylene. In addition, cover 20 may not have the multilayered design depicted and may be manufactured from a solid material, such as a polymer, metal, or resin.

Overlying top ply 34 on roof vent 10 is a layer of shingles 50. Shingles 50 may be adhered to cover 20 with an adhesive or fasteners, such as nails (not shown), which may be driven through the shingles 50 and cover 20 into underlayment 15 for holding the entire assembly to the roof.

In operation, hot or warm air in the structure beneath the roof may vent out of vent openings 18 into the open area between cover 20 and ridge board 12/underlayment 15. The air vents from roof vent 10 by passing through the passages defined between coils 34 of springs 26-32. The vented air will pass through springs 28 and 32 first and then through respective springs 26 and 30 to ambient atmosphere.

Figure 3:
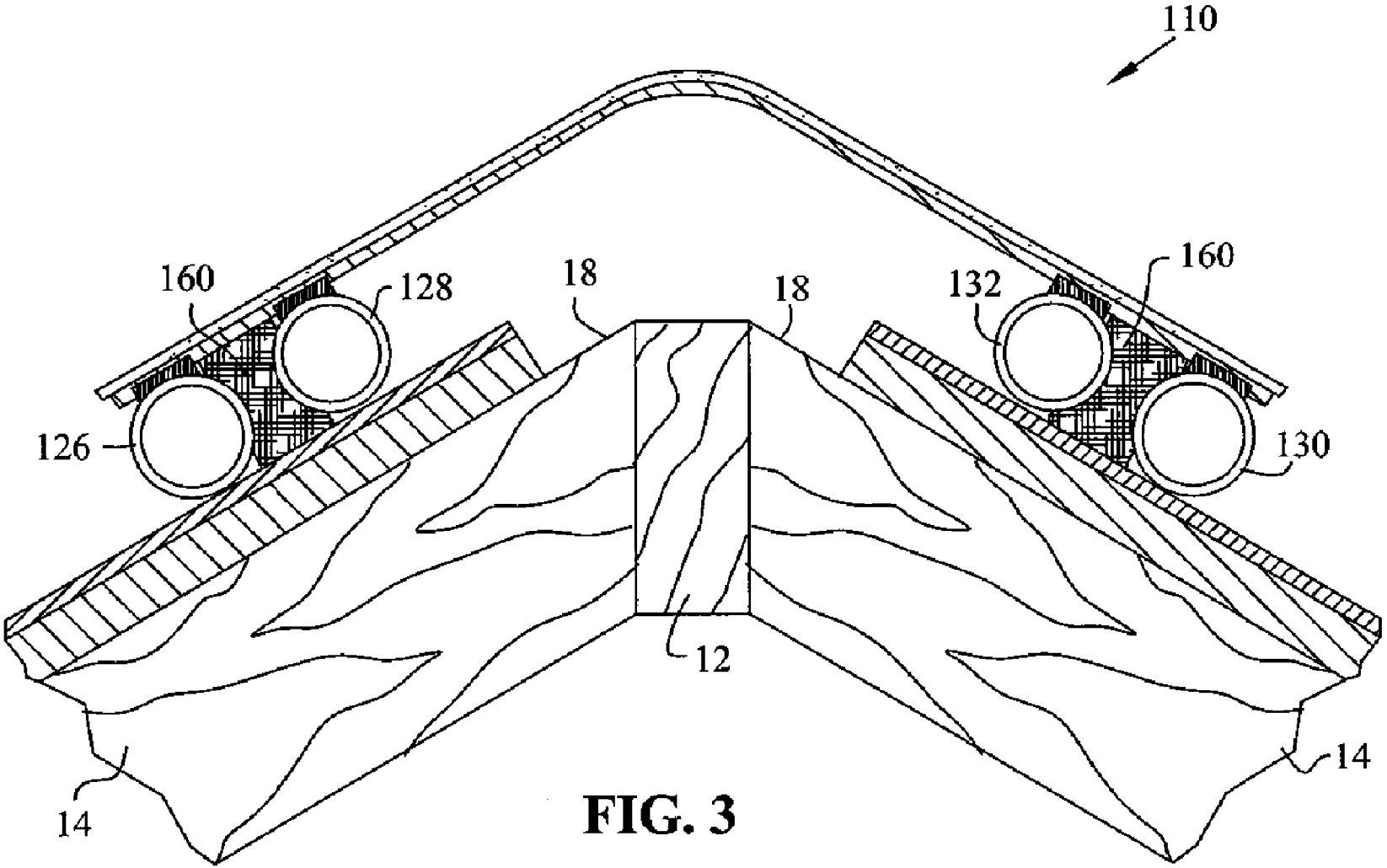
FIG. 3 is an end view of the roof ridge vent of FIG. 1, including a filter for use with the ridge vent.

Now referring to FIG. 3, an alternate embodiment roof vent 110 is shown. Roof vent 110 is similar in most respects to roof vent 10 and includes similar spiral spring supports/coiled members 126, 128, 130, and 132. In addition, roof vent 110 includes an air-permeable, moisture-resistant filter material 160 that is located between respective springs 126, 128 and 130, 132. In this embodiment, the filter material 160 is a nonwoven batting material with randomly oriented fibers and may be made from such materials as polyester, nylon, or olefin. In addition, other air-permeable materials, such as open cell foam may also be used. Filter material 160 may be held by compression between the spring elements or may be secured using an adhesive.

In operation, air will vent from roof vent 110 in a manner similar to that of roof vent 10 with the vented air passing through the air-permeable filter material 160 while it is passing from respective springs 128 to 126 and 132 to 130. In addition, though, any snow or wind-driven moisture will be inhibited from entering into the interior of roof vent 110 and into vent openings 118, as it will be blocked by the filter material 160. Because of the pitch of the roof, any moisture or moisture from the melting of snow that has been blocked by the filter material will drain down shingles 16 and off the eaves of the roof instead of entering vent openings 18.

Figure 4:
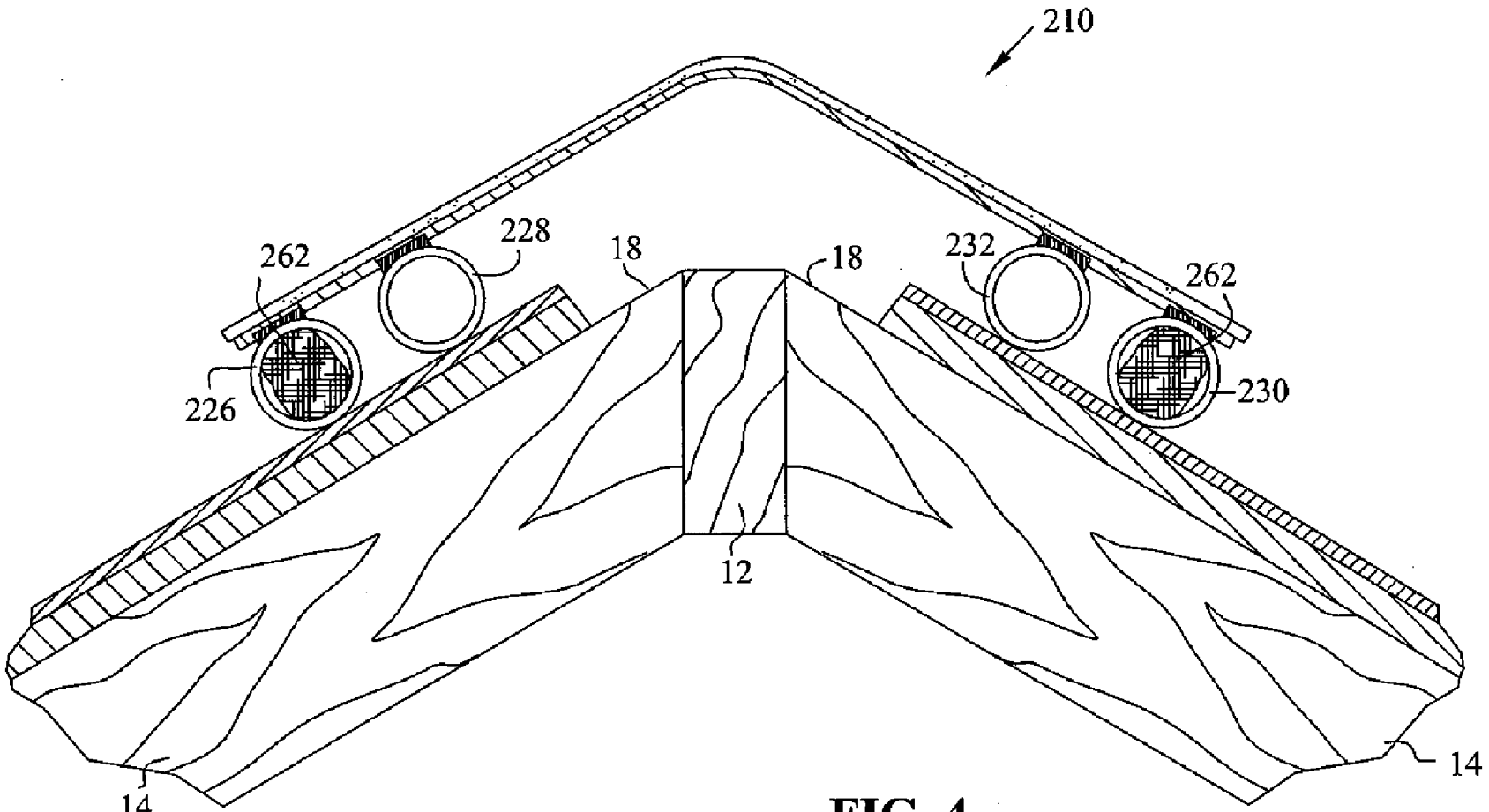
FIG. 4 is an end view of the ridge vent of FIG. 1, showing another alternate filter design for use with the ridge vent.

Now referring to FIG. 4, another embodiment of a roof vent is shown generally indicated as 210. Roof vent 210 includes spiral spring supports/coiled members 226, 228, 230, and 232, which are similar to springs 26-32 of roof vent 10. Roof vent 210 includes an air-permeable, moisture-resistant filter material 260 located within the coils of springs 226 and 230. Filter material 260 can be similar to filter material 160 and may be a nonwoven batting or an open cell foam, for example. Filter material 260 may be held by compression within the coils of the springs or may be attached using an adhesive or other method. In addition, it should be realized that filter material 260 could alternately be placed in inner springs 228 and 232 or the filter material may be located within all of the springs for increased resistance to moisture penetration. Roof vent 210 will operate similarly to roof vent 110 as described above.

Figure 5:
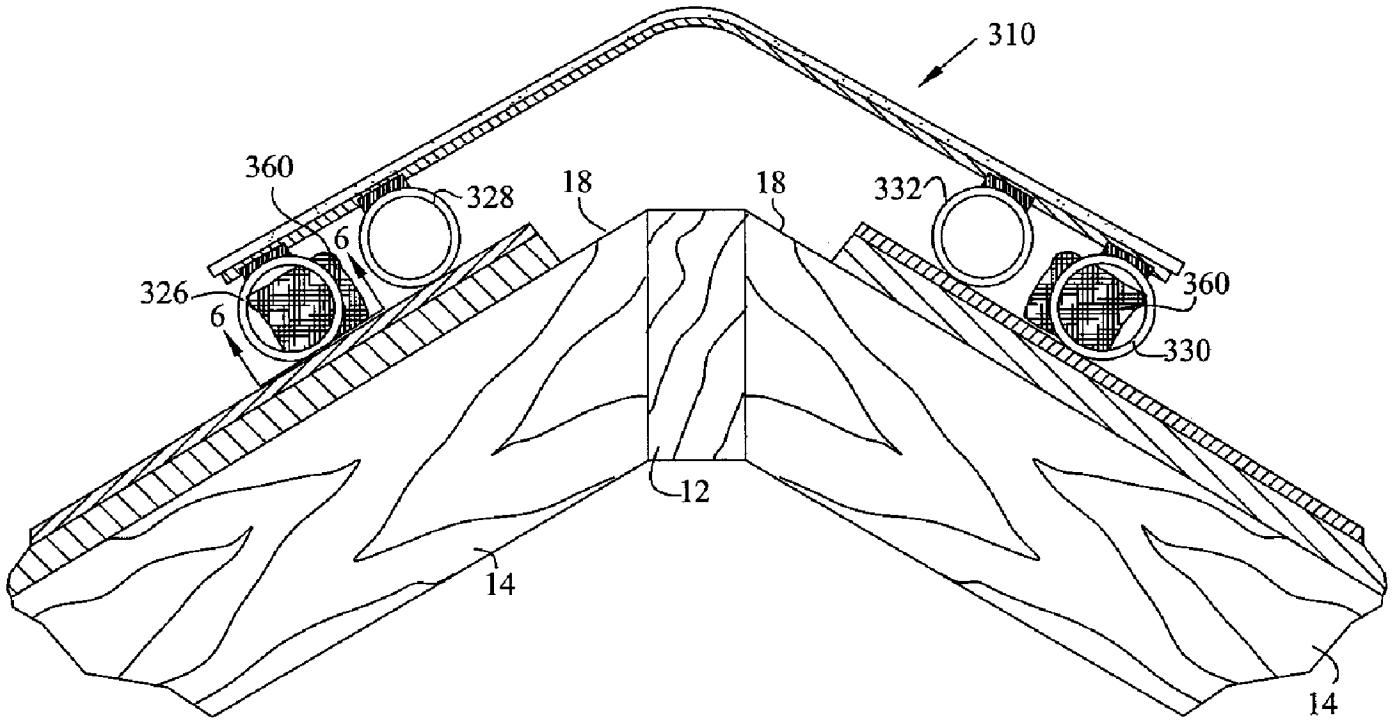
FIG. 5 is an end view of the ridge vent of FIG. 1, showing another alternate filter design for use with the ridge vent.
Figure 6:
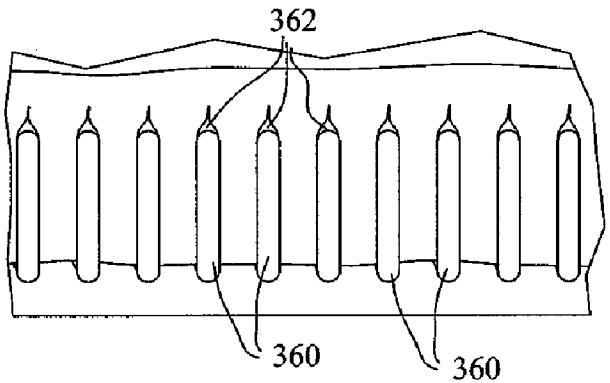
FIG. 6 is a bottom plan view of the vent and filter design of FIG. 5.

Now referring to FIGS. 5 and 6, another alternate embodiment of a roof vent is generally indicated as 310. Roof vent 310 includes spiral spring supports/coiled members 326, 328, 330, and 332, which are similar to springs 26-32 of roof vent 10. Roof vent 310 also includes an air-permeable, moisture-resistant filter material 360, which is located partially within the coils of springs 326 and 330. Filter material 360 can be made from a similar filter material as filter material 160 and may be a nonwoven batting or open cell foam, for example. In this embodiment, the filter material includes a plurality of slits 362, spaced apart to approximately the same distance as the coils on springs 326 and 330. The filter material 360 is positioned on springs 326 and 330, the coils of the springs at least partially extending into slits 362 as best shown in FIG. 6. Filter material 360 may also be adhered to the coiled springs for increased holding resistance. It should be realized that filter material 360 could alternately be placed on inner springs 228 and 232 or the filter material may be located on all of the springs for increased resistance to moisture penetration. Roof 310 will operate similarly to roof vent 110 and 210 as described above.

Figure 7:
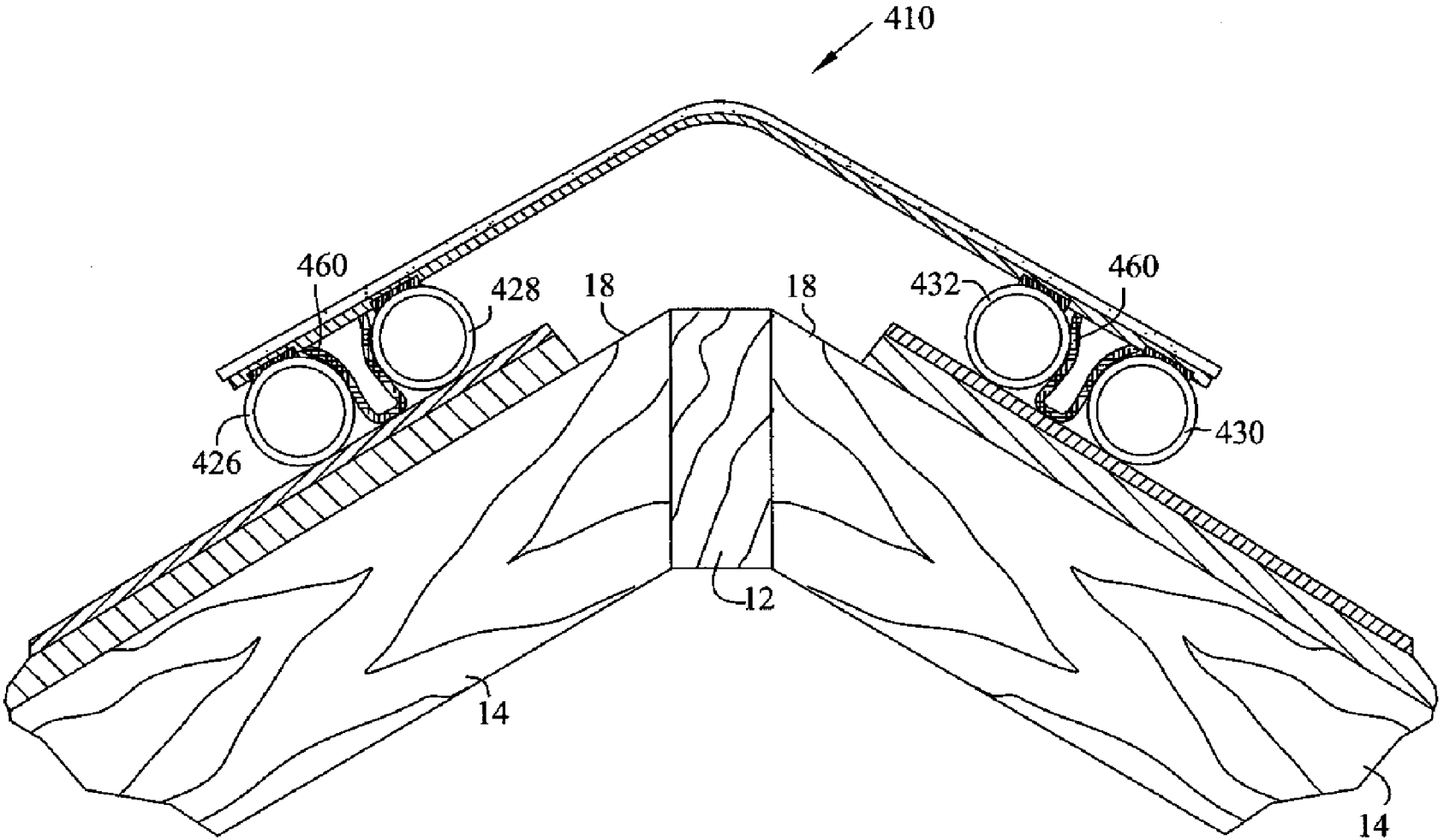
FIG. 7 is an end view of the ridge vent of FIG. 1, showing another alternate filter design for use with the ridge vent.

Now referring to FIG. 7, another alternate embodiment of a roof vent is shown generally indicated as 410. Roof vent 410 includes spiral spring supports/coiled members 426, 428, 430, and 432. Roof vent 410 also includes a filter material 460 that in this embodiment is an air-permeable, moisture-resistant fabric. The fabric may be woven or nonwoven material, and in one embodiment, may include spun bonded randomly arranged polypropylene fibers. In the embodiment shown in FIG. 7, filter material 460 is folded in a generally U configuration and held between respective springs 426, 428 and 430, 432. Filter material 460 may also be adhered to or otherwise attached to the cover of roof vent 410 and/or springs 426-432. Roof vent 410 will operate in a similar manner as described above for the roof vents 110, 210, and 310. It should also be realized that the shape of the filter material may be varied from that shown in FIG. 7 to a closed loop or as otherwise desired.

Figure 8:
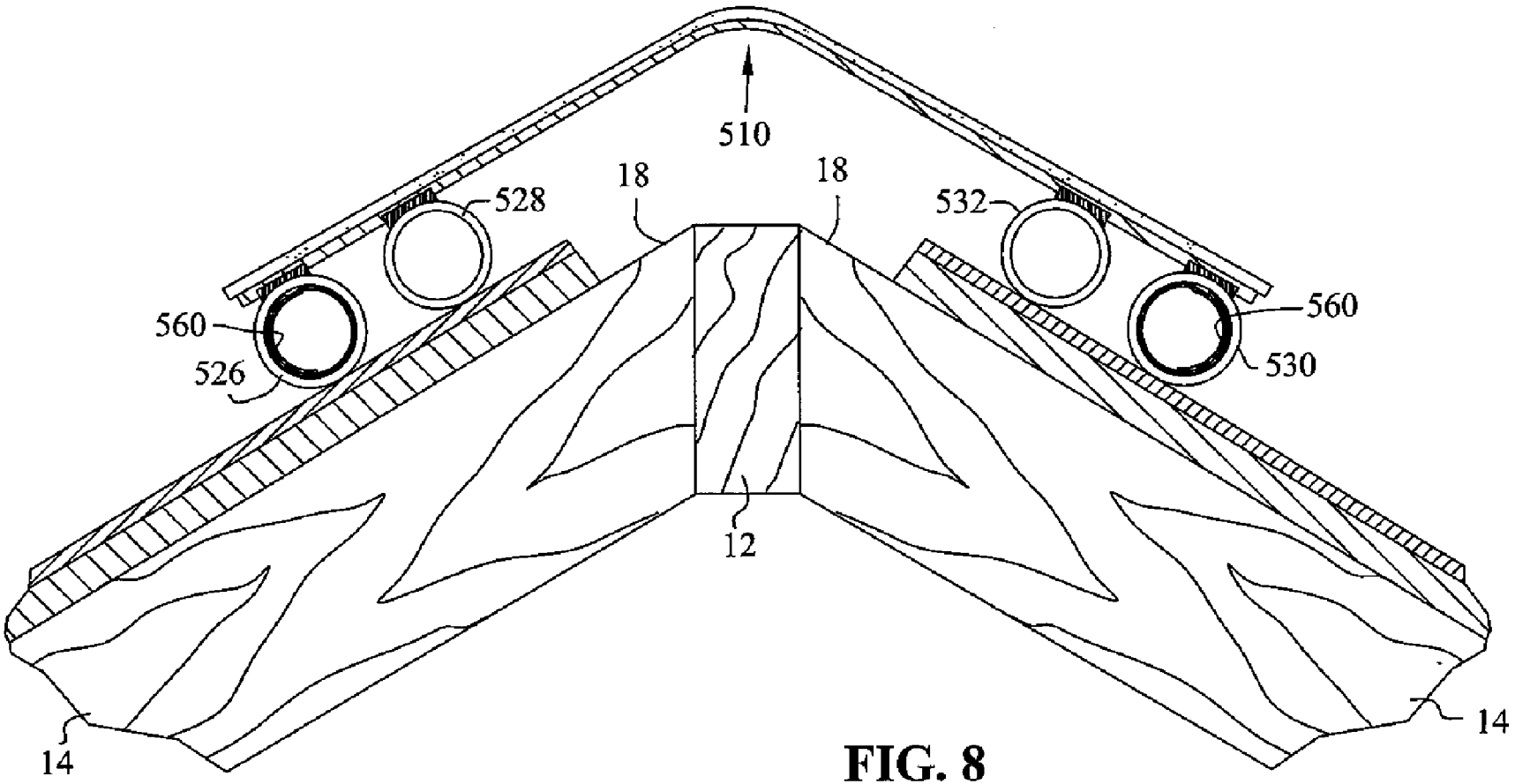
FIG. 8 is an end view of the ridge vent of FIG. 1, showing another alternate filter design with a fabric material wrapped on the inside of the vent p

Now referring to FIG. 8, another embodiment of the roof vent is shown generally indicated as 510. Roof vent 510 includes spiral spring supports/coiled members 526, 528, 530, and 532, which are similar to springs 26-32 of roof vent 10. Roof vent 510 also includes a filter material 560 that, in the embodiment shown, is an air-permeable, moisture-resistant fabric that may be similar to that described above for filter material 460. In the embodiment shown in FIG. 8, the filter fabric of filter material 560 is rolled into cylinders and inserted into the interior of the coils of springs 526 and 530. The ends of the fabric material may be adhered or otherwise attached to one another or may be free. It should also be appreciated that filter material 560 may alternately be placed in inner springs 538 and 532 or the filter material may be located within all of the springs for increased resistance to moisture penetration. Roof vent 510 will operate similarly to roof vents 110, 210, 310, and 410 as described above.

Figure 9:
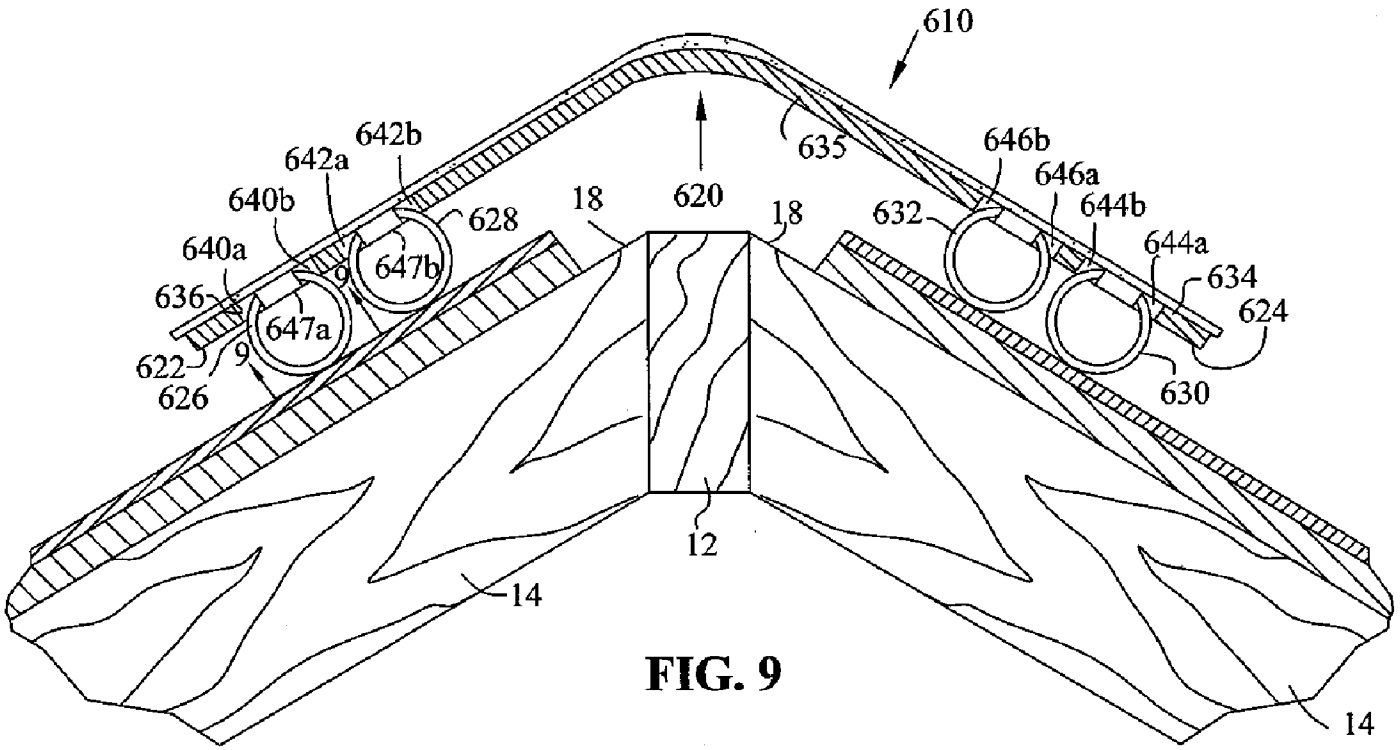
FIG. 9 is an end view of another embodiment of the ridge vent having an alternate means of attachment to a top cover.
Figure 10:
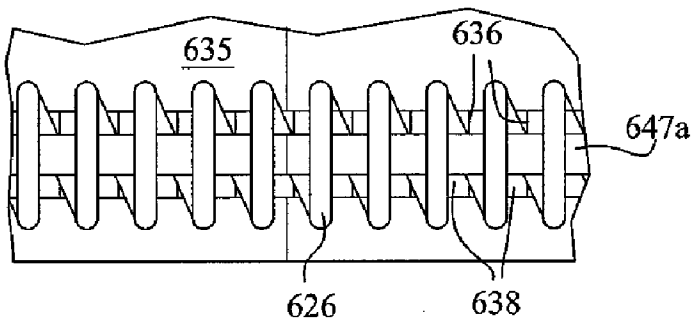
FIG. 10 is a partial bottom plan view of the ridge vent of FIG. 9.

Referring now to FIGS. 9 and 10, another alternate embodiment of a roof vent is generally indicated as 610. Roof vent 610 includes a cover or cap generally indicated as 620 having side portions 622 and 624. Roof vent 610 includes spiral spring supports/coiled members 626, 628, 630, and 632, which are similar to springs 26-32. Roof vent 610 utilizes an alternate approach for attachment of springs 626, 632 from the previous embodiments. In the embodiment depicted in FIGS. 9 and 10, cover 620 has a multiple layered or plied configuration and includes a top ply 634, a bottom ply 635, and connecting members 636 extending between and connecting top ply 634 to bottom ply 635. A plurality of passages 638 are defined by top ply 634, bottom ply 635, and connecting member 636 and extend therebetween. As with cover 620, passages 638 are oriented in a direction that is approximately perpendicular to vent openings 18 and ridge board 12. Furthermore, cover 620 includes a pair of slots 640*a*-640*b*, 642*a*-642*b*, 644*a*-644*b*, and 646*a*-646*b* coinciding with the attachment of each of the springs 626-632, respectively. Slots 640*a-b* to 646*a-b*, are formed by the removal of portions of bottom ply 635 and may extend into connecting members 636. The slots do not extend into top ply 634. Slots 640*a, b* to 646*a, b* extend in a longitudinal manner and are generally parallel to one another and vent openings 18 and ridge board 12. Located between each pair of slots 640*a, b* to 646*a, b* is a remaining portion 647*a*, 647*b*, 647*c*, and 647*d*, respectively, of bottom ply 635 located therebetween.

In the embodiment of roof vent 610, springs 626-632 are attached to cover 620 by threading spring spirals or coils through passages 638 interstitially between connecting members 636 in the area between respective slots 640*a, b* and 646*a, b*. The remaining portions 647*a-d* of bottom ply 635 between the slots will hold the springs in place to the cover. The springs may be further secured to cover 620 through the use of adhesives or other attachment means.

Roof vent 612 will operate in a manner the same as described above for roof vent 10. In addition, it should be appreciated that any of the filter materials or arrangements shown with roof vents 110, 210, 310, 410, or 510, may be utilized with this roof vent design.

Figure 11:
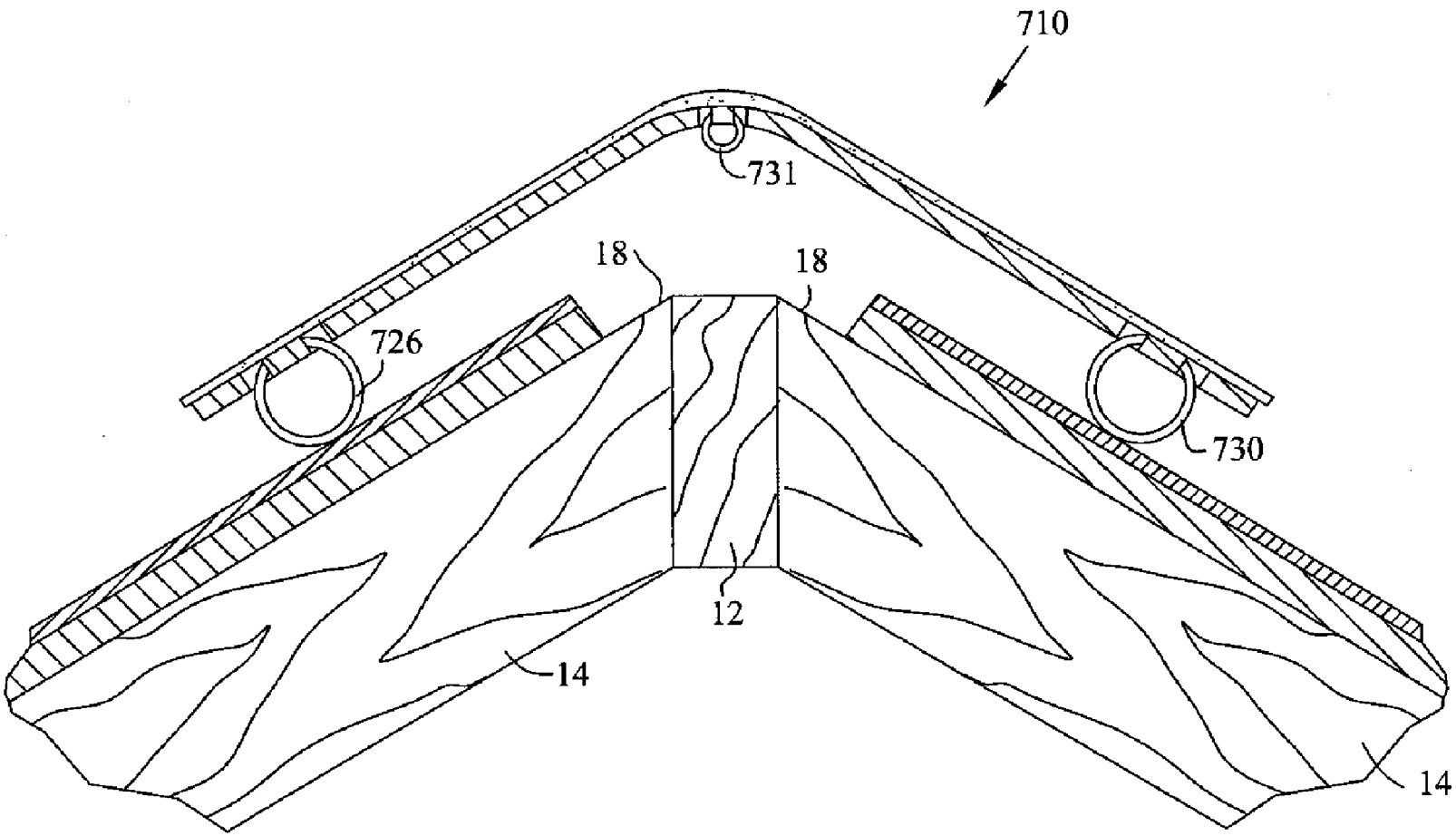
FIG. 11 is an end view of another embodiment of a ridge vent according to the present invention having a single spiral vent part attached along each side of the top panel and a central spiral connecting part.
Figure 12:
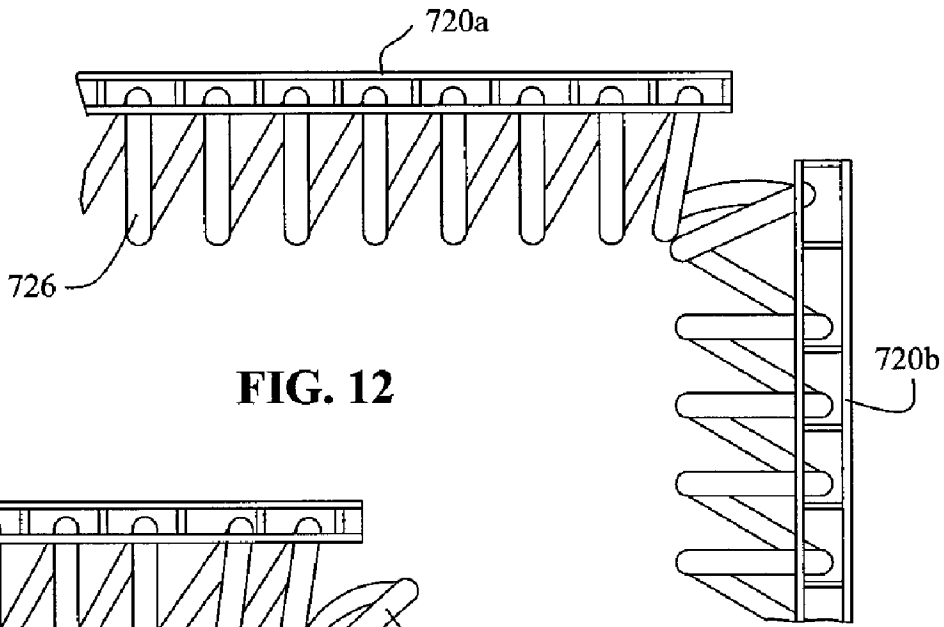
FIG. 12 is a side view of the embodiment of the ridge vent of FIG. 9 shown bent at an angle of approximately 90° along a split between sections.
Figure 13:
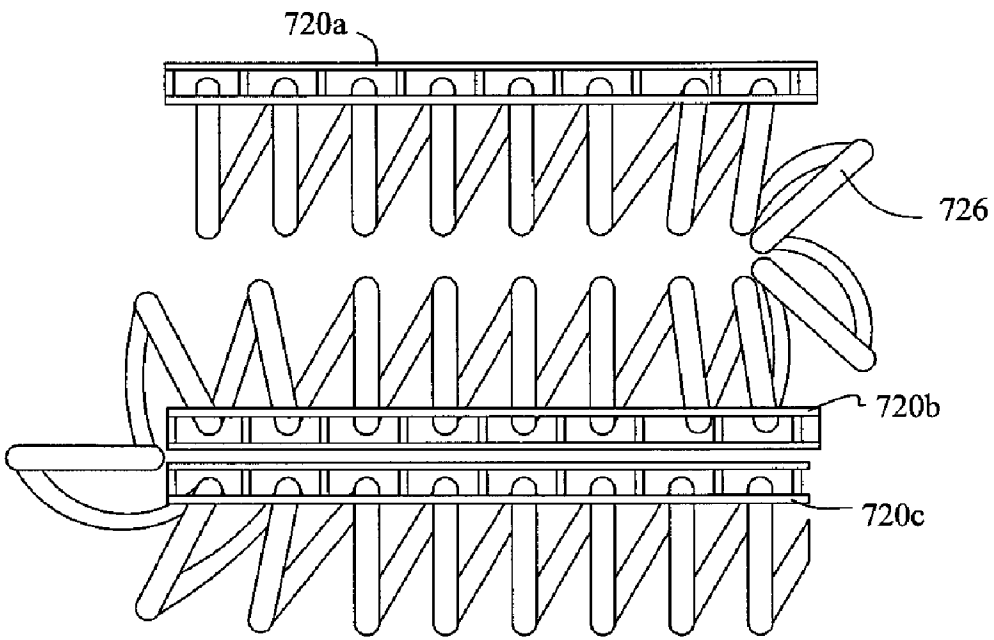
FIG. 13 is a side view of the embodiment of the ridge vent of FIG. 9 shown with sections folded over in opposite directions for packaging of the product.

Now referring to FIGS. 11-13, another embodiment of a roof vent generally indicated as 710 is shown. Roof vent 710 includes a pair of spiral spring supports/coiled members 726 and 730 that are attached in the same manner as spring supports 626-632 to cover 620 in the embodiment of roof vent 610. In addition, roof vent 710 includes a central spring 731 that is attached in the same manner. In the embodiment shown, central spring 731 is smaller than springs 726 and 730 to avoid contact with ridge board 12. Roof vent 710 will operate in a manner similar to roof vent 10 and may utilize any of the filter materials or structures shown in the previous embodiments.

In addition, the cover of roof vent 710 is split into sections 720*a*, 720*b*, and 720*c*, as shown in FIGS. 12 and 13. The split between the cover sections runs approximately transverse to ridge board 12 and vent openings 18 and is parallel to the passages in the cover members. As can be appreciated from FIGS. 12 and 13, an advantage of the subject invention is that the cover sections 720*a*-720*c* may be folded at the splits with the connection between the splits being maintained by the springs. This may be of particular benefit for packaging and shipping longer sections of roof vent 710. When folding the vent in this manner, it should be appreciated that the top plies of sections 720*b* and 720*c* will face and be adjacent one another while the bottom plies of sections 720*a* and 720*b* will face one another.

Figure 14:
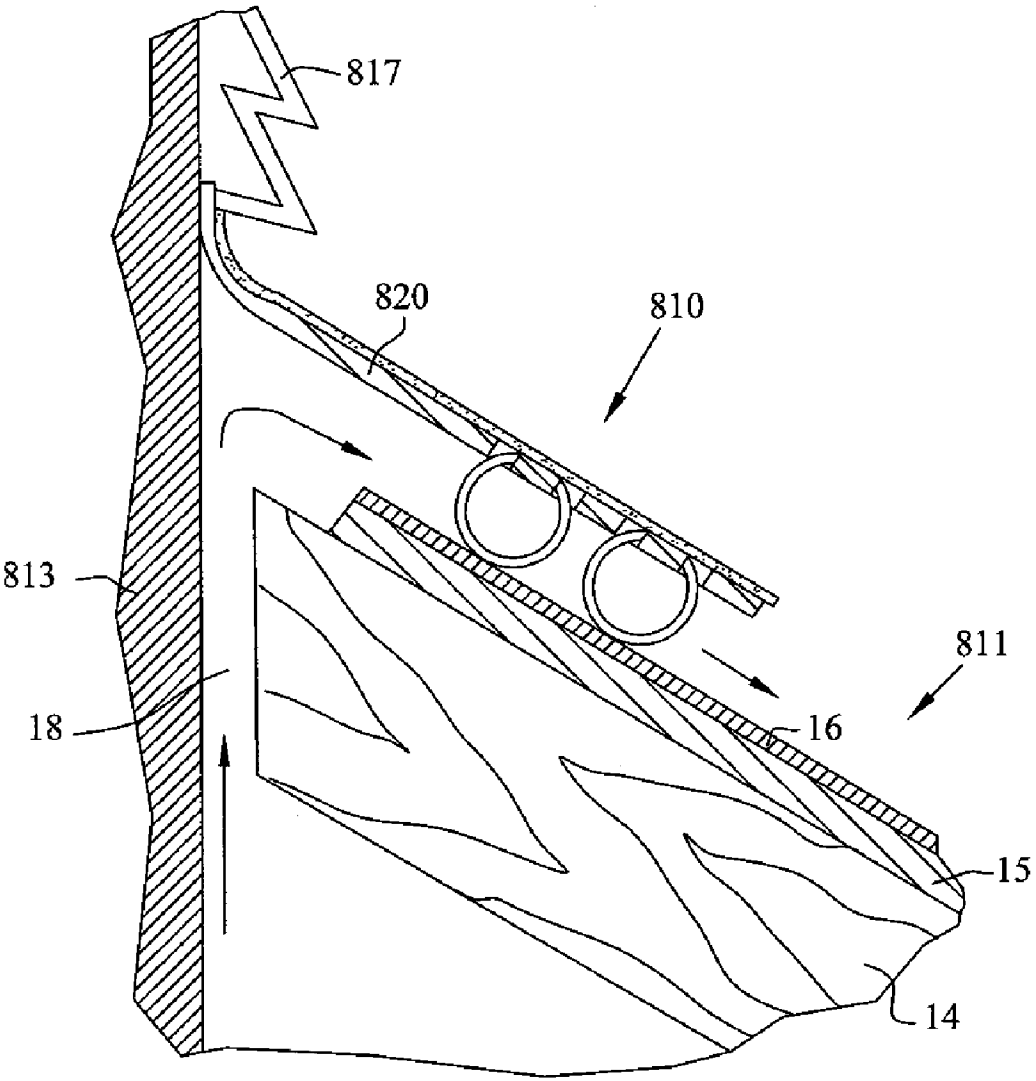
FIG. 14 is an end view of another embodiment of a vent for use with a roof attached to a vertical wall.

Referring now to FIG. 14, another embodiment of a roof vent is shown generally indicated as 810. Roof vent 810 is for use on a roof generally indicated as 811 that is attached to and extends from a vertical wall 813 having siding 817 covering the portion above roof 811. In the embodiment shown, roof vent 810 includes a cover/cap 820 having a top ply, a bottom ply, and connecting members similar to cover/cap 20 discussed above. Attached to cover 820 is a pair of spiral spring supports/coiled members 826, 830, which are attached the same as spiral spring supports 626-632 on roof vent 610. Additionally, cover/cap 820 may be extended to at least partially underlie siding 817 to provide a moisture barrier to prevent water and precipitation from entering the vent opening area between roof 811 and wall 813. Installed in the manner shown in FIG. 14, roof vent 810 allows air to vent from beneath roof 811 in the manner depicted. Any of the filter embodiments previously discussed may be used with this or the other vent embodiments.

Figure 15:
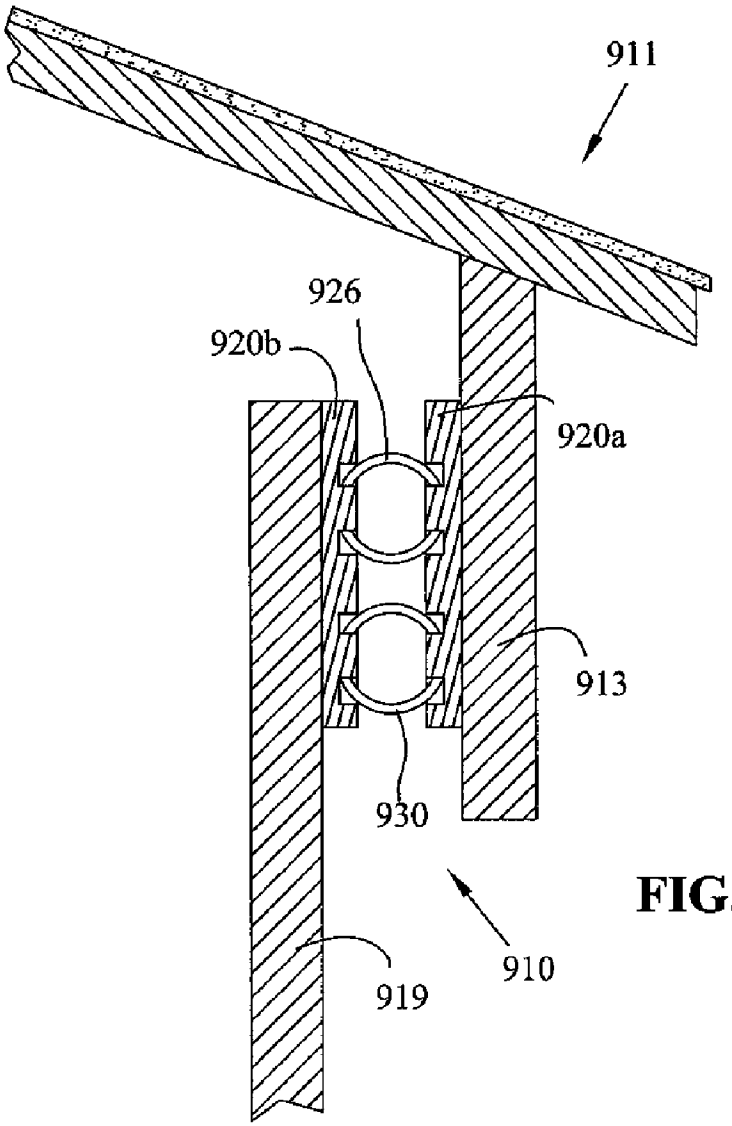
FIG. 15 is an end view of another embodiment of a vent for use along the eaves of a roof.

Referring now to FIG. 15, another vent is shown generally indicated as 910. Vent 910 is designed for use around the eaves of a roof of 911. In this embodiment, vent 910 is positioned behind a facia board 913 and in front of a wall 919. Vent 910 includes a pair of caps 920*a*, 920*b* having configurations similar to cap 20. Connecting caps 920*a* and 920*b* are spiral spring supports/coiled members 926 and 930 in a manner similar to the way spiral spring supports 626-632 are attached to cap 620 in vent 610. Vent 910 may be installed by attaching cap 920*b* to wall 919 and then applying facia board 913 over cap 920*a*. This embodiment will permit air from the exterior of the structure to vent into the interior through vent 910 between facia board 913 and wall 919.

Figure 16:
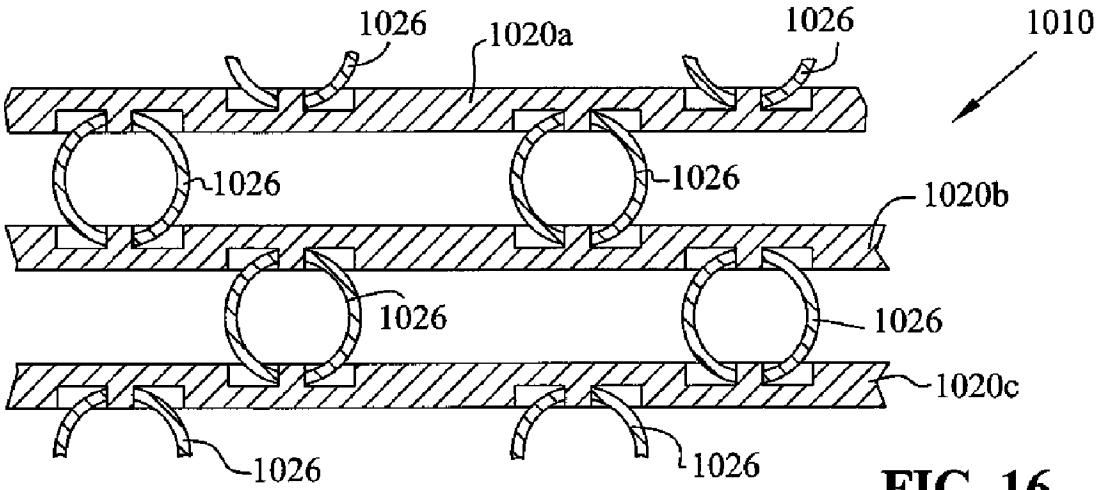
FIG. 16 is an end view of an alternate embodiment vent having multilayered stacked spiral vent parts.

Referring now to FIG. 16, a cross sectional view of a multilayered vent in accordance with the subject invention is shown generally indicated as 1010. This embodiment illustrates that using a multilayered technique, the vent may be manufactured in any number of desired layers or thicknesses. Vent 1010 includes mounting members or layers 1020*a*, 1020*b*, and 1020*c*, which on this embodiment have a structure similar to that of cover 20. Interconnecting mounting members 1020*a*, 1020*b*, and 1020*c* are spiral spring supports 1026, which may be threaded onto the mounting members or otherwise attached or adhered thereto as described in any manner set forth above. It should also be appreciated that the vent configuration 1010 may be employed in any of the different vent configurations discussed above or in other vents that may take advantage of the unique and diverse properties of this type of vent.

Figure 17:
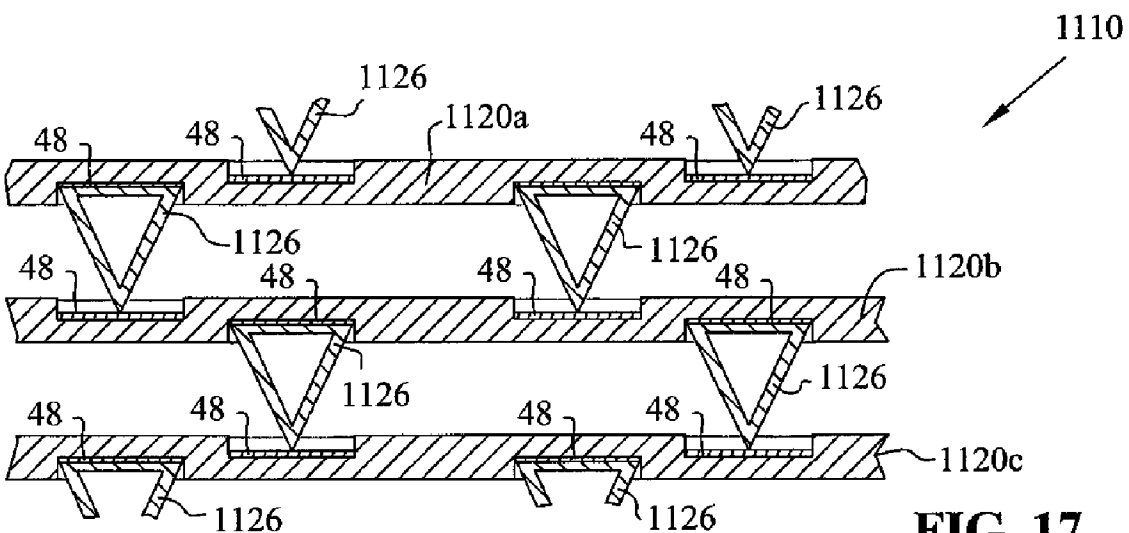
FIG. 17 is an end view of another embodiment of a multilayered stacked vent part having triangular-shaped supports.

Now referring to FIG. 17, another multilayered vent is shown generally indicated as 1110. Vent 1110 includes mounting members or layers 1120*a*, 1120*b*, 1120*c*, the same as or similar to vent mounting members 1020*a*, 1020*b*, 1020*c*; however, instead of spiral spring supports, vent 1110 utilizes triangular-shaped supports 1126 connecting the mounting members. It should be appreciated that such triangular-shaped supports may be coiled, intermittent, or include passages so that air may pass between mounting members 1120*a*, 1120*b*, 1120*c*. Triangular-shaped supports 1126 may be attached to the mounting members by use of an adhesive layer or member or other known attachment means.

Figure 18:
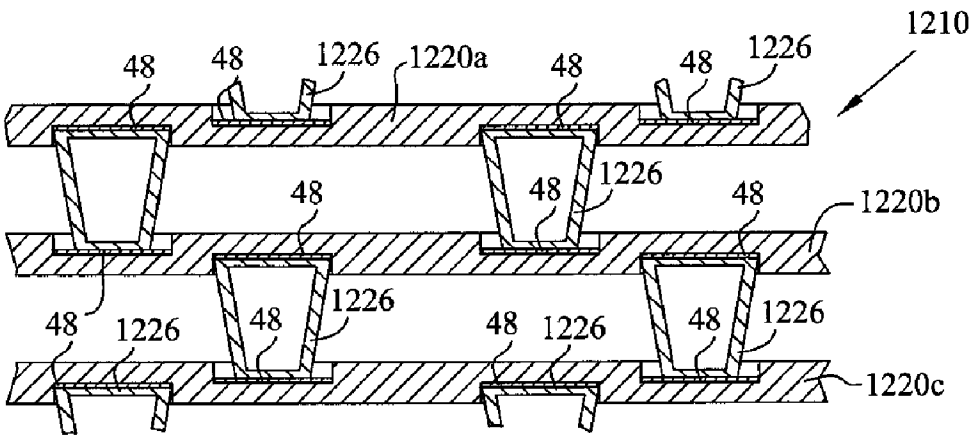
FIG. 18 is an end view of yet another embodiment of a multilayered stacked vent part having trapezoidal-shaped supports.

In FIG. 18, another multilayered vent generally indicated as 1210 in FIG. 18 and 1210 is similar to vents 1010 and 1110, and includes mounting members or layers 1220*a*, 1220*b*, and 1220*c*. Vent 1210, however, utilizes trapezoidal-shaped supports 1226 to attach and connect the mounting members. Vent

1210's trapezoidal-shaped supports 1226 may be coiled, intermittent, or have passages to permit air to flow between mounting members 1220*a*, 1220*b*, and 1220*c*. Trapezoidal-shaped supports 1226 may be attached with adhesive or an adhesive member or other known attachment means to the mounting members. It should be realized that in addition to the shapes shown for the supports in FIGS. 16-18, other suitable shapes for the supports may be utilized in a similar manner. In addition, the thickness, materials and size of the supports can be varied as desired.

Figure 19:
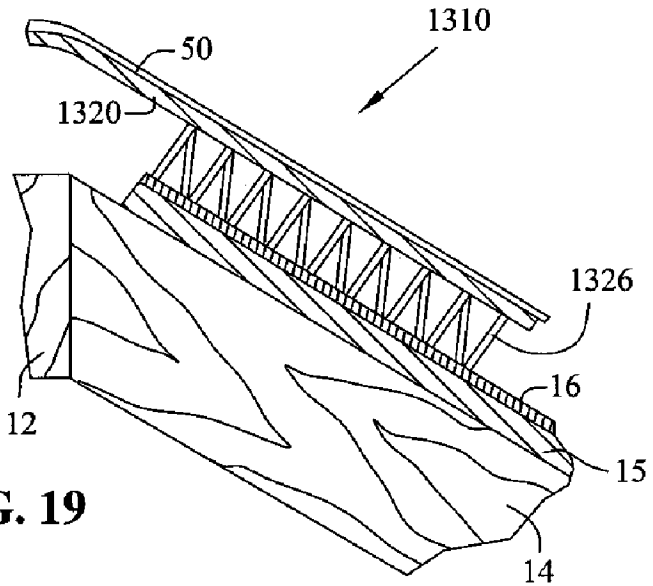
FIG. 19 is an end view of another embodiment of a ridge vent having spiral spacers extending perpendicular to the ridge.

Another embodiment of a vent is shown generally indicated as 1310 in FIG. 19. Vent 1310 includes a cover or cap 1320 and spiral spring supports 1326. The orientation of spiral spring supports 1326 differs from the embodiment shown in FIGS. 1-11 in that it runs transverse to or at an angle to the longitudinal direction of ridge board 12 instead of parallel thereto. Spiral spring supports 1326 may be attached to cover 1320 as described above for the other vents by being threaded thereto or with an adhesive or adhesive member. It should be realized, however, that in order to thread spiral support 1326 onto cover 1320, the cover should be rotated 90° from the way it is shown in FIG. 1 so that passages 38 run parallel to ridge board 12 instead of perpendicular thereto. It should also be appreciated that a vent may incorporate supports both parallel to ridge board 12 and at an angle thereto as support 1326.

Figure 20:
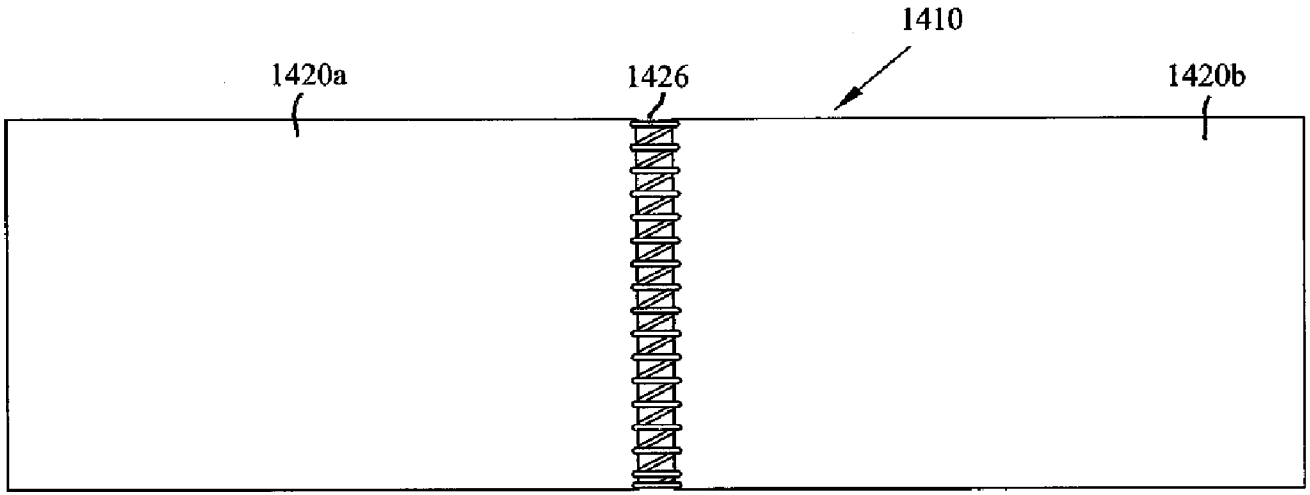
FIG. 20 is a top plan view of vent parts connected together with a spiral member extending along the joint between the parts.

Now referring to FIG. 20, a vent generally indicated as 1410 is shown in a plan view. Vent 1410 includes cover/cap members 1420*a* and 1420*b* similar to the other cover members discussed above. Vent 1410 also includes a spiral connecting member 1426. Spiral connecting member 1426 connects cover members 1420*a* to 1420*b* and is preferably threaded through openings placed through the covers adjacent edges thereof. It should be appreciated that this will allow vent 1410 to be folded about the spiral connecting member 1426 or otherwise allow one cover member to be angled relative to the other to adjust to contours in a roof. It should also be appreciated that spiral connecting member 1426 may be utilized as shown with any of the previous embodiments disclosed above.

Figure 21:
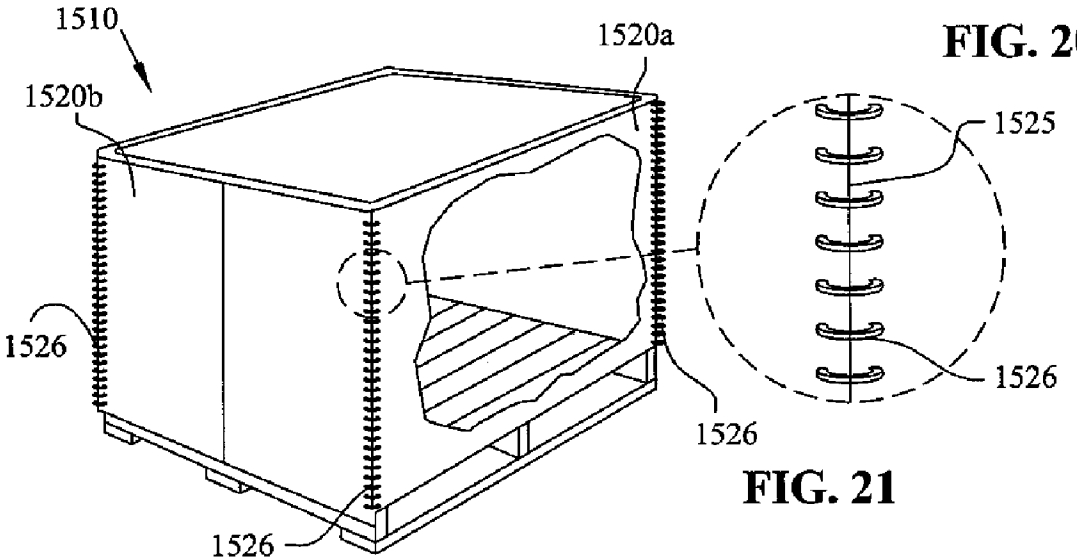
FIG. 21 is a cargo box having spiral members joining the vertical corners thereof.

Now referring to FIG. 21, a cargo container is generally indicated as 1510. Cargo container 1510 has sides 1520*a*, 1520*b*, and corner connections 1525. The corner connections are made with spiral members 1526 that connect sides 1520*a*, 1520*b* in a manner similar to the way spiral connecting member 1426 connects covers 1420*a* to 1420*b*.

While the invention has been taught with specific reference to these embodiments, one skilled in the art will recognize that changes can be made in form and detail without departing from the spirit and scope of the invention. For example, an additional cover member may be provided with any of the above embodiments and the spiral members may be sandwiched therebetween. Additionally, the size and shape of the springs of the coil members may be varied as desired and the number of coils in the embodiments may be increased or decreased as desired depending upon the rigidity of the springs and support needed. The described embodiments are to be considered, therefore, in all respects only as illustrative and not restrictive. As such, the scope of the invention is indicated by the following claims rather than by the description.

What is claimed is:

1. A ventilating device for a roof having a longitudinally extending ridge board and at least one vent opening adjacent the ridge board, said ventilating device comprising:

a cover extending over the ridge board and longitudinally along the vent opening, said cover including two plies of material, a top ply and a bottom ply, each ply extending along the majority of the length and width of said cover spaced apart by connecting members extending between said plies; and coiled members extending longitudinally along said cover on opposite sides of the vent opening to support the cover over the vent opening, said coiled members being defined by spaced coils defining passages therebetween to permit venting of the structure through the vent opening and said passages defined by said coils, a portion of said bottom ply of material being removed, and forming a substantially continuous channel, where said coiled members are attached to said cover.

2. The ventilating device as set forth in claim 1, further including at least one air-permeable filter member to inhibit moisture and debris from entering in the vent opening through said passages.

3. The ventilating device as set forth in claim 2, wherein said air-permeable filter member is installed within the coils of at least one of said coil members.

4. The ventilating device as set forth in claim 3, wherein said air-permeable filter member is a thin sheet of air-permeable, moisture-resistant fabric material that is rolled within at least one of said coiled members.

5. The ventilating device as set forth in claim 2, wherein said filter member is an air-permeable, moisture-resistant thin sheet of fabric that is wrapped at least partially around the outside of at least one of said coiled members.

6. The ventilating device as set forth in claim 2, wherein said filter member is an air-permeable, moisture-resistant thin sheet of fabric that is folded over and positioned between two coiled members.

7. The ventilating device as set forth in claim 2, including a foam or batting material positioned between two coiled members.

8. The ventilating device as set forth in claim 2, wherein said air-permeable filter member is a foam or batting material with spaced slits for receiving at least a portion of said spaced coils.

9. The ventilating device as set forth in claim 1, wherein said portion of said bottom ply of material is removed along the longitudinal direction of said ventilating device.

10. The ventilating device as set forth in claim 8, wherein said coil members are attached to said cover, where said bottom ply has been removed using an adhesive or an adhesive member.

11. The ventilating device as set forth in claim 1, wherein two adjacent longitudinal portions of said bottom ply of material are removed for the attachment of each coil member.

12. The ventilating device as set forth in claim 11, wherein said spaced coils of said coil members are threaded interstitially between said connecting members extending between said plies of said cover and held by the portion of the bottom ply remaining between said adjacent longitudinally removed portions of said bottom ply.

13. The ventilating device as set forth in claim 11, wherein said longitudinally removed portions of said bottom ply are parallel to one another.

14. A ventilating device for a roof having a longitudinally extending ridge board and at least one vent opening adjacent the ridge board, said ventilating device comprising:

a cover extending over the ridge board and longitudinally along the vent opening, said cover including two plies of material, a top ply and a bottom ply, spaced apart by connecting members extending between said plies and transverse to the ridge board; and spiral coiled members extending longitudinally along said cover on opposite sides of the vent opening to support the cover over the vent opening, said coiled members being defined by spaced coils defining passages therebetween to permit venting of the structure through the vent opening and said passages defined by said coils, and said coiled members being rationally screw threaded onto said cover with said spaced coils located interstitially between said connecting members extending between said plies.

15. The ventilating device as set forth in claim 14, wherein two longitudinally extending portions of said bottom ply of material are removed in an area where said coil members are threaded onto said cover.

16. The ventilating device as set forth in claim 15, including two longitudinally extending slots, where said bottom ply portions are removed, said slots being parallel to one another.

17. A ventilating device for a roof having a longitudinally extending ridge board and at least one vent opening adjacent the ridge board, said ventilating device comprising:

a cover extending over the ridge board and longitudinally along the vent opening, said cover including two plies of material, a top ply and a bottom ply, spaced apart by connecting members extending between said plies;

coiled members extending longitudinally along said cover on opposite sides of the vent opening to support the cover over the vent opening, said coiled members being defined by spaced coils defining passages therebetween to permit venting of the structure through the vent opening and said passages defined by said coils, and said coiled members being threaded onto said cover with said spaced coils located interstitially between said connecting members extending between said plies; and an additional longitudinally extending coil member attached to the cover along the central portion thereof.

18. The ventilating device as set forth in claim 17, wherein the coil member extending along the central portion of the cover is attached thereto in the same manner as the venting coil members.

19. The ventilating device as set forth in claim 14 wherein said cover is split in at least one location in a direction that is substantially perpendicular to the longitudinal direction coinciding with the ridge board.

20. The ventilating device as set forth in claim 19, wherein said cover includes sections on opposite sides of said split, and said sections are held together by said coiled members.

21. The ventilating device as set forth in claim 20, wherein said ventilating device is foldable along said splits.

22. A ventilating device for a roof having a longitudinally extending ridge board and at least one vent opening adjacent the ridge board, said ventilating device comprising:

a cover extending over the ridge board and longitudinally along the vent opening, said cover including two plies of material, a top ply and a bottom ply, spaced apart by connecting members extending between said plies, said cover being split into at least two separated sections, wherein said separated sections are not connected to one another by said top ply or said bottom ply; and coiled members extending longitudinally along said cover on opposite sides of the vent opening to support the cover over the vent opening, said coiled members being defined by spaced coils defining passages therebetween to permit venting of the structure through the vent opening and said passages defined by the coils, said coils joining said split sections of said cover member to one another.

23. The ventilating device as set forth in claim 22, wherein the splits between said sections are substantially perpendicular to the longitudinal direction coinciding with the ridge board.

24. The ventilating device as set forth in claim 22 wherein said ventilating device is foldable along the splits between said sections.

25. The ventilating device as set forth in claim 24, wherein said cover includes at least three sections in said covering, and said ventilating device is folded so that a top ply of one section is adjacent a top ply of another section and the bottom ply of said another section is adjacent the bottom ply of the third section.

26. The ventilating device as set forth in claim 22, wherein said coiled members are threaded onto said cover with said spaced coils located interstitially between said connecting members extending between said plies.

27. The ventilating device as set forth in claim 26, wherein two longitudinally extending portions of said bottom ply of material are removed in an area where said coil members are threaded onto said cover.

28. The ventilating device as set forth in claim 27, including two longitudinally extending slots, where said bottom ply portions are removed, said slots being parallel to one another.

29. A ventilating device for a use in venting a structure having a vent opening, said ventilating device comprising:

at least one cover including at least two plys of material, a top ply and a bottom ply, spaced apart by connecting members extending between said plys, said bottom ply extending for the majority of the length and width of said cover; and support members extending along said cover and attached thereto, said support members defining passages therebetween to permit venting of the structure through the vent opening, and said passages and a portion of said bottom ply of material being removed and forming a substantially continuous channel, where said support members are attached to said cover.

30. The ventilating device as set forth in claim 29, further including at least one air-permeable filter member to inhibit moisture and debris from entering the vent opening through said passages.

31. The ventilating device as set forth in claim 29, wherein said support members are attached to said cover, where said bottom ply has been removed, using an adhesive or an adhesive member.

32. The ventilating device as set forth in claim 29, wherein two adjacent portions of said bottom ply material are removed for attachment of each support member.

33. The ventilating device as set forth in claim 32, wherein said support members include coils that are threaded interstitially between said connecting members extending between said plys of said cover and held by the portion of the bottom ply remaining between said adjacent longitudinally removed portions of said bottom ply.

34. The ventilating device as set forth in claim 29, wherein said support members extend at an angle from the vent opening.

35. The ventilating device as set forth in claim 34, wherein said support members extend generally perpendicular to the vent opening.

36. The ventilating device as set forth in claim 29, wherein said cover is split into at least two portions and a coiled member is used to join said portions.

37. The ventilating device as set forth in claim 36, wherein said coiled member joining said portions is threaded into each of the portions of the cover along edges thereof.

38. The ventilating device as set forth in claim 29, wherein the support members have a triangular configuration.

39. The ventilating device as set forth in claim 29, wherein the support members have a trapezoidal configuration.

40. The ventilating device as set forth in claim 29, including a second layer also attached to the support members and running generally parallel to said cover member.

41. The ventilating device as set forth in claim 40, including a second set of support members attached to said layer on a side opposite said other support members.

42. The ventilating device as set forth in claim 41, including a third layer attached to said second set of coiled members and parallel to said cover and other layer.

* * * * *